United States Patent [19]

Mullen et al.

[11] 4,064,381

[45] Dec. 20, 1977

[54] PUSHBUTTON SWITCH ASSEMBLY HAVING FLOATING TYPE BRIDGING CONTACT AND LOST MOTION ACTUATOR

[75] Inventors: John H. Mullen; Stephen S. Dobrosielski, both of Beaver, Pa.

[73] Assignee: Westinghouse Electric Corporation, Pittsburgh, Pa.

[21] Appl. No.: 658,952

[22] Filed: Feb. 18, 1976

[51] Int. Cl.[2] ..... H01H 13/12; H01H 1/20; H01H 3/48

[52] U.S. Cl. ..... 200/16 A; 200/153 V; 200/243; 200/247; 200/307

[58] Field of Search ..... 200/16 A, 153 V, 159 R, 200/165, 163, 243, 245, 247, 307, 329, 330, 340, 314

[56] References Cited

U.S. PATENT DOCUMENTS

| | | | |
|---|---|---|---|
| 2,748,210 | 5/1956 | Frank | 200/16 A X |
| 2,811,617 | 10/1957 | Townsend | 200/243 |
| 3,018,338 | 1/1962 | Mullen et al. | 200/16 A |
| 3,136,868 | 6/1964 | Mullen | 200/16 A X |
| 3,170,054 | 2/1965 | Lawrence et al. | 200/16 A X |
| 3,238,341 | 3/1966 | Haydu | 200/243 |
| 3,253,092 | 5/1966 | Landow | 200/16 A |
| 3,272,949 | 9/1966 | Lawrence et al. | 200/247 X |
| 3,436,497 | 4/1969 | Mading | 200/153 V |
| 3,437,773 | 4/1969 | Koertge | 200/243 |
| 3,514,554 | 5/1970 | Boysen | 200/307 X |
| 4,006,322 | 2/1977 | Gallatin et al. | 200/16 A |

*Primary Examiner*—James R. Scott
*Attorney, Agent, or Firm*—L. P. Johns

[57] ABSTRACT

A pushbutton switch structure characterized by a pushbutton switch handle and a plurality of switch blocks mounted in tandem, each switch block having an operating plunger for simultaneous operation by said switch handle carrier means associated with the plunger for carrying movable contacts between open and closed positions of stationary contacts, the plunger and carrier means having spaced complementary surface means engageable during movement of the plunger, whereby actuation of the pushbutton handle effects simultaneous operation of all of the plungers and a delay of movement of movable contacts from the normally closed position.

7 Claims, 5 Drawing Figures

PUSHBUTTON SWITCH ASSEMBLY HAVING FLOATING TYPE BRIDGING CONTACT AND LOST MOTION ACTUATOR

BACKGROUND OF THE INVENTION

1. Field of the Invention

This invention relates to a pushbutton electric switch structure for moving a plurality of switch blocks simultaneously while delaying the movement of the movable contacts.

2. Description of the Prior Art

Electric switches are commonly employed in circuits for controlling electrical apparatus. Such switches may be of the pushbutton type or the rotary type, and each type of switch is often used in locations where accidental or mistaken alteration of a particular electrical circuit may have serious detrimental consequences. Examples of such switches are disclosed in U.S. Pat. Nos. 2,748,210; 3,333,079; 3,511,955 and 3,367,206.

In the past, some contact block assemblies have involved a problem of a gradual deterioration of the movable and stationary contacts due to wear or arc burning. The eventual result of such deterioration is a failure of the contact block. This is true notwithstanding the usual overtravel provisions for most movable contact carriers. Accordingly, there has been a need for a more satisfactory overtravel structure in which the contacts are closed notwithstanding deterioration due to the usual wear and arc burning effects.

SUMMARY OF THE INVENTION

In accordance with this invention, it has been found that the foregoing problem may be overcome by providing a pushbutton switch structure comprising a plurality of switches mounted in tandem, each switch having a reciprocable switch operating plunger, a pushbutton member supported for rectilinear reciprocable movement against the plunger, each switch comprising one set of upper stationary contacts and one set of lower stationary contacts, the switch also comprising a pair of movable contacts movable between the sets of upper and lower contacts and comprising a bridging movable contact carrier unit, first means biasing said unit to maintain the movable contacts normally closed with respect to the upper set of contacts, second biasing means between the plunger and the unit for holding the plunger in a fully retracted position and against the pushbutton member when the movable contacts were normally closed at the upper contacts, the plunger comprising an extension extending in the direction of its movement and abuttable with the plunger of an adjacent switch, the extension having a first outturned surface, the unit having a corresponding outturned surface in the path of movement of and spaced from the first outturned surface to effect movement of the bridging movable contact carrier unit to the lower stationary contacts when the pushbutton member is actuated.

The advantage of the device of this invention is that it provides for simultaneous movement of the plungers of all tandem switches but incorporates a delay in the movement of the movable contacts. In other words, there is no free play in the movement of the several aligned plungers, which free play in the past has resulted in little, if any, movement of a plunger in the end switch where a plurality of switches are stacked in tandem.

DESCRIPTION OF THE PREFERRED EMBODIMENTS

Figure 1:
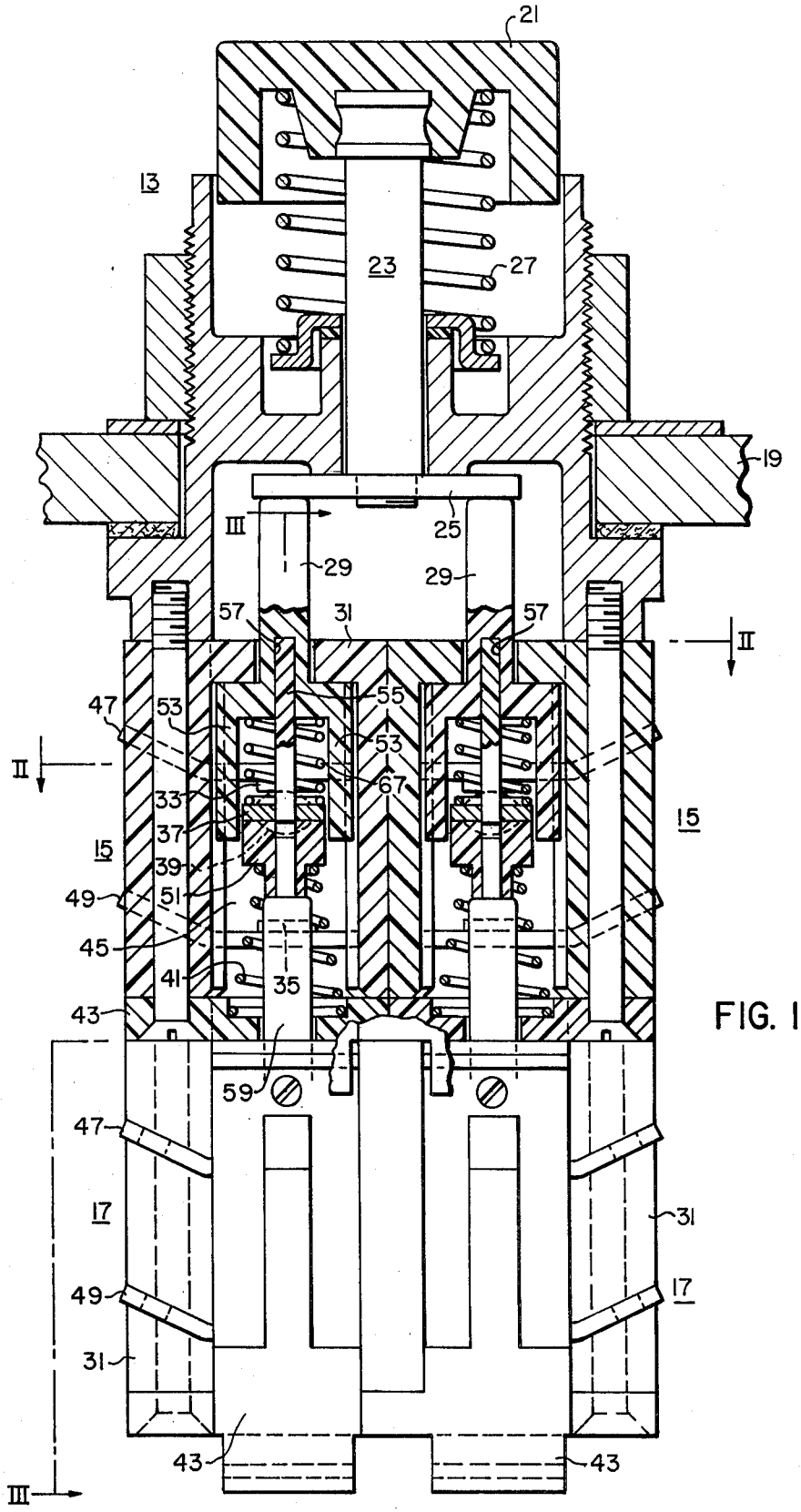
FIG. 1 is a vertical sectional view through a pushbutton switch and pairs of contact blocks mounted in tandem.

In FIG. 1, a pushbutton switch structure is generally indicated at 11 and it comprises a pushbutton actuating unit 13 and at least two switch units or contact blocks 15, 17. Inasmuch as a detailed description of the actuating unit is set forth generally in U.S. Pat. No. 3,136,868, the description of the actuating unit is limited to the parts that are essential to the operation of the invention disclosed herein. The actuating unit 13 is mounted on a support panel 19 and comprises a pushbutton 21, a rod 23, a disk 25 and a return spring 27.

Figure 3:
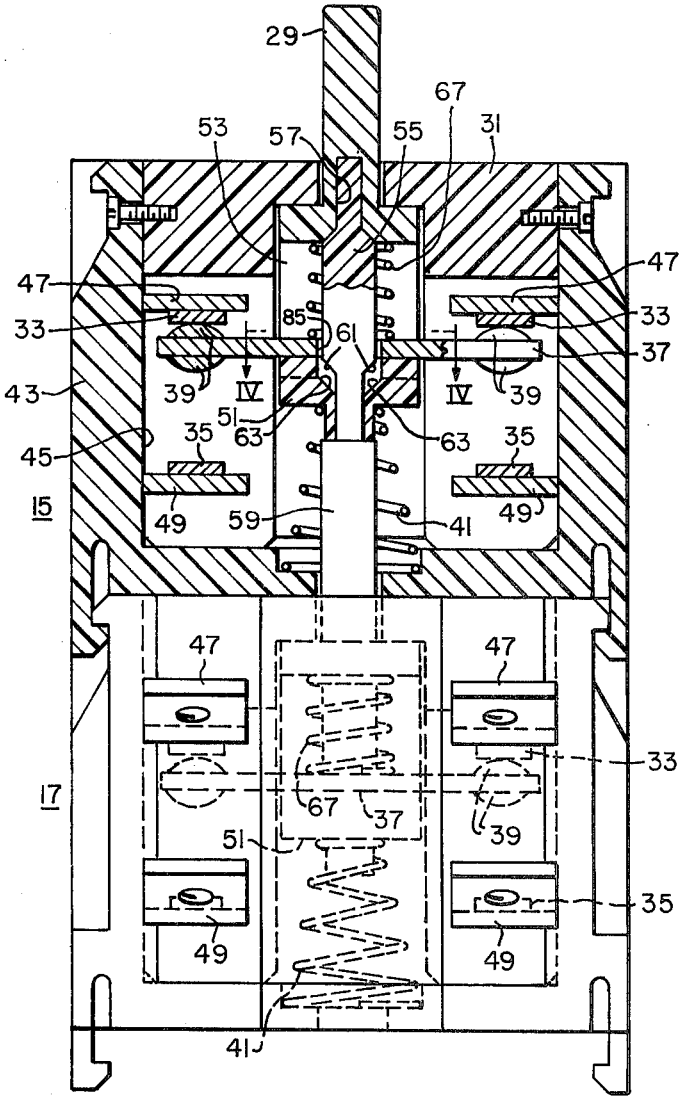
FIG. 3 is a vertical sectional view taken on the line III—III of FIG. 1.

Each contact block 15, 17 as shown for one of the blocks 15, comprises an actuating member or plunger 29, a housing 31, a first or upper set of stationary contacts 33, a second or lower set of stationary contacts 35, a bridging contact carrier 37 for movable contacts 39, and an operating spring 41. The housing 31 together with a cover 43 are composed of an electrically insulating material. When assembled, the housing 31 and cover 43 provide an inner compartment 45 in which the several other parts are disposed. As shown in FIG. 3, the plunger 29 is axially disposed and is movable longitudinally within the center of the block 15.

Figure 2:
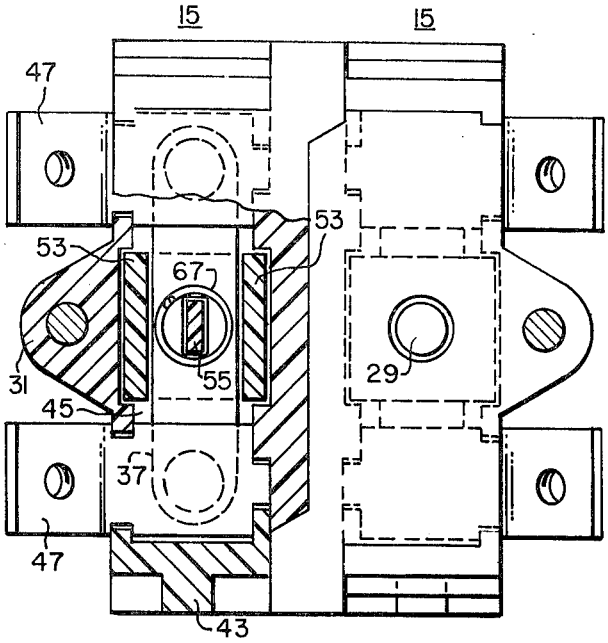
FIG. 2 is a horizontal sectional view taken on the line II—II of FIG. 1.

The first stationary contacts 33 are disposed on opposite sides of the plunger 29 and are mounted on similar spaced terminals 47 (FIG. 2). The second or lower stationary contacts 35 are mounted on similar terminals 49. Both terminals 47, 49 extend through the wall of the housing with outer extremities accessible for connection to electrical conductors in a conventional manner. The bridging movable contact carrier 37 together with a support guide 51 comprise a movable contact carrier unit for supporting and guiding the movable contacts 39 in place between corresponding pairs of upper and lower contacts 33, 35, upon movement of the plunger 29. As shown in FIG. 1, the plunger 29 includes a bifurcated lower portion having similar legs 53 between which the bridging contact carrier 37 and the support guide 51 are mounted. The spring 27 retains the assembly of the plunger 29, the bridging contact carrier 37, and the support guide 51 in the uppermost position with the movable contacts 39 in normally closed position with the stationary contacts 33. Manifestly, lowering of the plunger 29 moves the movable contacts 39 to closed position with the lower pairs of stationary contacts 35.

Figure 4:
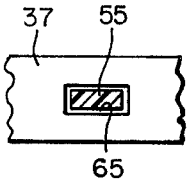
FIG. 4 is a horizontal sectional view taken on the line IV—IV of FIG. 3.

In accordance with this invention, the plunger 29 also includes a shaft or extension 55, the upper end of which is seated in a socket 57 of the plunger 29. The lower end of the extension 55 is in contact with the upper end of a plunger 59 of the next adjacent contact block 17, whereby lowering of the plunger 59 simultaneously moves the plunger 29. The extension 55 includes one and preferably two outturned surfaces 61 which are spaced from a corresponding pair of outturned surfaces 63 in the support guide 51. The outturned surfaces 61 are spaced from the outturned surfaces 63 by a suitable distance, such as 1/16th inch. As shown in FIG. 4, the bridging contact carrier 37 comprises an aperture 65 so that the extension 55 is movable therethrough. In addition, an overtravel spring 67 is disposed between the plunger 29 and the bridging contact carrier 37, so that the assembly of the bridging contact carrier 37 and the support guide 51 are compressed together between the overtravel spring 67 and the return spring 41.

In the normally closed position of the contacts, as shown in FIG. 3, the return spring 41 having a greater force than the overtravel spring 67, retains the contact block in the normally closed position. The force of the spring 41 is overcome by manual pressure on the plunger 29 only after the outturned surfaces 61 contact the outturned surfaces 63 on the support guide. Thereafter further lowering of the plunger lowers the contacts 39 from the stationary contacts 33 to the stationary contacts 35. In other words, the plunger 29 moves for a distance equal to the referred distance between the surfaces 61, 63, such as about 1/16th inch, before the movable contacts 39 begin to move off of the stationary contacts 33. Inasmuch as the pressure of the spring 41 exceeds that of the overtravel spring 67, the bridging contact carrier 37, being composed of a slightly flexible metal holds the contacts 39 firmly against the stationary contacts 33 as a result of a slight amount of overtravel. Thus, where any deterioration due to wear or marking between contacts 33, 39 occurs, the return spring 41 operates independently of the extension 55 to retain the movable contacts 39 in contact with the stationary contacts 37 due to the spacing between the outturned surfaces 61, 63.

Figure 5:
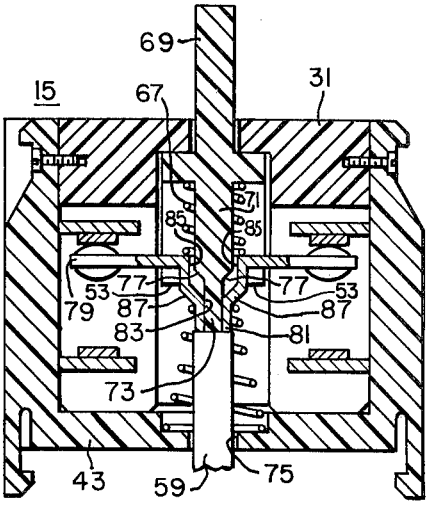
FIG. 5 is a sectional view of another embodiment of a single contact block.

Another embodiment of the invention is that shown in FIG. 5 in which similar parts have reference numbers corresponding to those shown in FIG. 3. In FIG. 5, a plunger 69 includes an integral extension 71, the lower portion 73 of which is in abutment with the plunger 59 of the next adjacent contact block which plunger extends through an aperture 75 in the housing. The plunger 69 also is provided with a pair of outturned surfaces 77 in a manner similar to the surfaces 61 (FIG. 3). A bridging movable contact carrier 79 which comprises the contact carrier unit for this embodiment, includes an integrally formed portion 81 which is a substantially cupshaped member having an opening 83 in the lower portion thereof for passage of the lower portion 73 of the plunger 69. The upper ends of the portion 81 are integral with the contact carrier 79 which likewise comprises an opening 85 through which the extension 71 of the plunger extends. Finally, the portion 81 comprises a pair of outturned surfaces 87 which are spaced slightly below the corresponding out-turned surfaces 77 and which are engaged by those surfaces when the plunger 69 is lowered in a manner similar to that shown in FIG. 3.

In conclusion, the device of this invention satisfies certain problems inherent in some of the contact block structures of the prior art, including the elimination of free play between aligned plungers of a plurality of contact blocks as well as provision for overtravel of deteriorated contacts to maintain electrical integrity through the switch unit.

What is claimed is:

1. A pushbutton switch structure comprising at least two contact blocks stacked in end-to-end surface abutment and on a longitudinal axis, each contact block having stationary and movable contacts, each block also having movable contact operating means including a guided reciprocable plunger, the plunger having an extension member in end-to-end abutment with the plunger of an adjacent block, manual means adjacent to one block and operatively connected to the plunger thereof, a bridging movable contact carrier unit extending laterally of the direction of movement of the plunger, a support guide for supporting the bridging movable contact carrier unit, said carrier unit and the support guide having aligned aperture means, the extension member extending through the aligned aperture means, the plunger having an outturned shoulder on the side of the carrier unit opposite the support guide, first biasing means between the carrier unit and the contact block for retaining the movable contact normally closed with the upper set of contacts, second biasing means between the outturned shoulder and the carrier unit for holding the plunger in a fully retracted position, the first biasing means having a greater force than the second biasing means, the extension having a first outturned surface facing the direction of movement of the plunger when opening the contacts, and the carrier unit having a second complementary outturned surface facing and spaced from the first outturned surface to effect delayed movement of the carrier unit when the plunger is actuated.

2. The pushbutton switch structure of claim 1 in which the aperture means includes the complementary outturned surface, ad said complementary surface is spaced from the first outturned surface by a distance less than the distance of travel of the reciprocable switch operating member.

3. The pushbutton switch structure of claim 2 in which the first biasing means maintains the movable contacts normally closed until after abutment of the outturned surfaces when the manual means is actuated.

4. The pushbutton switch structure of claim 1 in which the bridging movable contact carrier unit comprises a contact carrier and the carrier support guide, and the first and second biasing means holding said unit and said support guide together.

5. The pushbutton switch structure of claim 4 in which said carrier and support guide comprise aligned aperture means through which the extension extends, and the support guide including the outturned surface spaced from the first outturned surface.

6. The pushbutton switch structure of claim 1 in which the extension is a shaft detachably mounted on the reciprocable switch operating member.

7. The pushbutton switch structure of claim 6 in which the second biasing means hold the assembly of the reciprocable switch operating member and the shaft retracted from the bridging movable contact carrier unit.

* * * * *